US010804015B2

(12) United States Patent
Kwon et al.

(10) Patent No.: US 10,804,015 B2
(45) Date of Patent: Oct. 13, 2020

(54) ELECTRICAL STEEL SHEET AND METHOD FOR MANUFACTURING THE SAME

(71) Applicant: POSCO, Pohang-si (KR)

(72) Inventors: Oh-Yeoul Kwon, Pohang-si (KR); Won-Gul Lee, Pohang-si (KR); Chan-Hee Han, Pohang-si (KR); Hyun-Chul Park, Pohang-si (KR)

(73) Assignee: POSCO, Pohang-si (KR)

( * ) Notice: Subject to any disclaimer, the term of this patent is extended or adjusted under 35 U.S.C. 154(b) by 48 days.

(21) Appl. No.: 16/152,796

(22) Filed: Oct. 5, 2018

(65) Prior Publication Data

US 2019/0035524 A1 Jan. 31, 2019

Related U.S. Application Data

(63) Continuation-in-part of application No. 14/369,571, filed as application No. PCT/KR2012/009642 on Nov. 15, 2012, now abandoned.

(30) Foreign Application Priority Data

Dec. 29, 2011 (KR) ..... 10-2011-0145401

(51) Int. Cl.
*H01F 1/16* (2006.01)
*C21D 8/12* (2006.01)

(52) U.S. Cl.
CPC ..... *H01F 1/16* (2013.01); *C21D 8/1294* (2013.01)

(58) Field of Classification Search
None
See application file for complete search history.

(56) References Cited

U.S. PATENT DOCUMENTS 4,203,784 A 5/1980 Kuroki et al.
4,963,199 A 10/1990 Pavlik et al.
(Continued)

FOREIGN PATENT DOCUMENTS

CN 101492765 7/2009
EP 0870843 10/1998
(Continued)

OTHER PUBLICATIONS

Indian Office Action—Indian Application No. 5533/CHENP/2014 dated Dec. 20, 2018, citing US20090145526, WO2010103761, JP 2002-292484, EP0897016, WO2009082155 and US200901146316.
(Continued)

*Primary Examiner* — Adam Krupicka
(74) *Attorney, Agent, or Firm* — Cantor Colburn LLP

(57) ABSTRACT

Provided is an electrical steel sheet comprising: a groove formed in a surface of a steel sheet, wherein the groove includes a bottom surface, a first side surface extending from the bottom surface, and a second side surface extending from the bottom surface in opposite to the first side surface, wherein the groove has a depth from the surface to the bottom surface, a width in a rolling direction of the steel sheet, and a length in a width direction of the steel sheet, and wherein the groove is formed through laser-irradiation and removal of melt produced by the laser-irradiation; an opening defined by the bottom surface, the first side surface and the second side surface; and a first solidification portion formed on the first side surface of the groove. The first solidification portion is formed by a solidification of part of the melt produced from the laser-irradiation.

8 Claims, 7 Drawing Sheets

(56) References Cited

U.S. PATENT DOCUMENTS

| | | | |
|---|---|---|---|
| 6,368,424 | B1 | 4/2002 | Sakai et al. |
| 2009/0114316 | A1 | 5/2009 | Sakai et al. |
| 2009/0145526 | A1 | 6/2009 | Arai et al. |

FOREIGN PATENT DOCUMENTS

| | | |
|---|---|---|
| EP | 0897016 | 2/1999 |
| EP | 1880396 | 1/2008 |
| EP | 2006397 | 12/2008 |
| JP | 58026405 | 5/1981 |
| JP | 57002252 | 1/1982 |
| JP | 58005968 | 2/1983 |
| JP | 61117222 | 6/1986 |
| JP | 64047818 | 2/1989 |
| JP | 05202450 | 8/1993 |
| JP | 06057857 | 1/1994 |
| JP | 07072300 | 3/1995 |
| JP | 07220913 | 8/1995 |
| JP | 08006138 | 1/1996 |
| JP | 10204533 | 8/1998 |
| JP | 2000109961 | 4/2000 |
| JP | 2002292484 | 10/2002 |
| JP | 2002356750 | 12/2002 |
| JP | 2003129135 | 5/2003 |
| JP | 2006233299 | 9/2006 |
| JP | 2007002334 | 1/2007 |
| JP | 2008106288 | 5/2008 |
| JP | 2011511152 | 4/2011 |
| KR | 06063037 | 3/1994 |
| KR | 20000028848 | 5/2000 |
| KR | 20080010454 | 1/2008 |
| KR | 20100034896 | 4/2010 |
| KR | 20110124292 | 11/2011 |
| WO | 9724466 | 7/1997 |
| WO | 2006120985 | 11/2006 |
| WO | 2007052406 | 5/2007 |
| WO | 2009075328 | 6/2009 |
| WO | 2009082155 | 7/2009 |
| WO | 2010103761 | 9/2010 |
| WO | 2011125672 | 10/2011 |

OTHER PUBLICATIONS

Chinese Search Report—Chinese Application No. 201280065201.9, dated Jan. 6, 2015, citing WO 2010/103761 and CN 101492765.

European Search Report—European Application No. 12861844.4, dated Feb. 16, 2016, citing EP 1 880 396, WO 2010/103761, JP 2002 292484, EP 0 897 016, WO 2009/082155 and EP 2 006 397.

International Search Report—PCT/KR2012/009642 dated Mar. 4, 2013.

ELECTRICAL STEEL SHEET AND METHOD FOR MANUFACTURING THE SAME

TECHNICAL FIELD

The present invention relates to an electrical steel sheet, and more particularly, to a grain-oriented electrical steel sheet in which a magnetic domain of the steel sheet is miniaturized by forming a groove on a surface of the steel sheet by laser irradiation.

BACKGROUND ART

A grain-oriented electrical steel sheet is used as an iron core material of an electrical device such as a transformer, and in order to reduce a power loss of the electrical device and to improve efficiency thereof, it is necessary to provide a steel sheet having a magnetic characteristic of less iron loss and a high magnetic flux density.

In general, the grain-oriented electrical steel sheet refers to a material having texture (referred to as a "GOSS texture") oriented in a rolling direction through a hot rolling process, a cold rolling process, and an annealing process.

As a degree oriented in a direction in which iron is easily magnetized is high, the grain-oriented electrical steel sheet exhibits an excellent magnetic characteristic.

In order to improve the magnetic characteristic of the grain-oriented electrical steel sheet, a method for miniaturizing a magnetic domain is used. The method for miniaturizing a magnetic domain may be divided into a method for temporarily miniaturizing a magnetic domain and a method for permanently miniaturizing a magnetic domain according to whether or not an effect of improving magnetic domain miniaturization is maintained by a stress relief annealing process.

The method for temporarily miniaturizing a magnetic domain is a domain miniaturizing technology for miniaturizing a magnetic domain by 90° in order to minimize magneto-elastic energy generated by applying local compression stress onto a surface as heat energy or mechanical energy. The technology for temporarily miniaturizing a magnetic domain is divided into a laser magnetic domain miniaturizing method, a ball scratch method, and a magnetic domain miniaturizing method by plasma or ultrasonic waves according to an energy source that miniaturizes a domain.

The method for permanently miniaturizing a magnetic domain capable of maintaining an iron loss improvement effect after the annealing process may be divided into an etching method, a roll method, and a laser method. According to the etching method, since a groove is formed on the surface of the steel sheet by an electro-chemical corrosion reaction, it is difficult to control a groove shape (a groove width or a groove depth). Further, since the groove is formed in an intermediate process (before a decarburization annealing process or a high-temperature annealing process) for producing the steel sheet, it may be difficult to guarantee an iron loss characteristic of a final product. Furthermore, since an acid solution is used, the etching method may not be environmentally friendly.

The method for permanently miniaturizing a magnetic domain using a roll is a technology for miniaturizing a magnetic domain by processing a protrusion on a roll to form a groove having a predetermined width and depth on the surface of the steel sheet by a pressing method and performing the annealing process on the steel sheet after a process for permanently miniaturizing a magnetic domain to cause recrystallization of a lower portion of the groove.

However, according to the method for permanently miniaturizing a magnetic domain using a roll, stability and reliability of a mechanical processing may be unfavorable, and a process may be complicated.

According to the method for permanently miniaturizing a magnetic domain using a pulse laser, since the groove is formed by deposition, it is difficult to suppress a melted portion from being formed, so that it may be difficult to secure the iron loss improvement rate before the annealing process (the stress relief annealing (SRA) process). Further, only a simple magnetic domain miniaturizing effect due to the groove is maintained after the annealing process, and it may be difficult to transfer the steel sheet at a high speed.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide a method for miniaturizing a magnetic domain of a grain-oriented electrical steel sheet having advantages of improving iron loss improvement rates before and after an annealing process by forming a groove on a surface of the grain-oriented electrical steel sheet by irradiation of a continuous wave laser beam and forming a solidification portion of molten metal on a sidewall (an inner wall).

Technical Solution

An exemplary embodiment of the present invention provides an electrical steel sheet including a groove that is formed to have first and second side surfaces which face each other on a steel sheet, and a bottom surface, and an opening that is formed by removing solidification portions formed by solidifying melted byproducts of the steel sheet from the first and second side surfaces and the bottom surface in the forming of the groove to expose at least one surface of the first side surface, the second side surface, and the bottom surface.

When a side surface distance (C) is defined as a distance between a boundary formed by a surface of the steel sheet and the side surface and a center of the bottom surface of the groove, the solidification portion formed on the first side surface or the second side surface may occupy 2% or more of the side surface distance.

When a groove shape factor is defined as (depth ($D_G$) of groove)/(lower full width at half maximum ($W_1$)) at the time of forming the groove, the groove shape factor may be 0.1 to 9.0. Here, the depth ($D_G$) of the groove is a distance between the surface of the steel sheet and the bottom surface, and the lower full width at half maximum ($W_1$) is half of a length of the bottom surface in a rolling direction of the steel sheet.

A width of the groove may be in a range of 10 μm to 70 μm.

A depth of the groove may be 0.5 μm or less.

A thickness of the solidification portion may be in a range of 0.05 $W_1$ to 5 $W_1$. Here, the $W_1$ means a lower full width at half maximum, and the lower full width at half maximum ($W_1$) is half of a length of the bottom surface in a rolling direction of the steel sheet.

As the solidification portion formed on the first or second side surface is closer to the bottom surface, a thickness of the solidification portion may be decreased, and as the solidification portion formed on the first or second side surface is closer to the surface of the steel sheet, the thickness of the solidification portion may be increased.

The electrical steel sheet may be a grain-oriented electrical steel sheet to which a tension coating process and a high-temperature annealing process for secondary recrystallization have been performed, or a grain-oriented electrical steel sheet to which the high-temperature annealing process for secondary recrystallization has been performed and the tension coating process is not performed.

Another exemplary embodiment of the present invention provides a method for manufacturing an electrical steel sheet including forming a groove having first and second side surfaces and a bottom surface by melting a surface of a steel sheet by laser irradiation, and forming an opening by removing melted byproducts of the steel sheet formed on the first and second side surfaces and the bottom surface through air blowing or suctioning to expose at least one surface of the first side surface, the second side surface, and the bottom surface in the forming of the groove.

The laser that irradiates the surface of the steel sheet may have a spherical shape or an oval shape.

When the groove is formed on the surface of the electrical steel sheet by the irradiation of the laser, a groove diameter ($B_W$) in a rolling direction may be 10 μm to 70 μm.

In order to form the groove diameter in the rolling direction, a width of the laser in the rolling direction, which irradiates the surface of the electrical steel sheet, may be 60 μm or less.

When the groove is formed on the surface of the electrical steel sheet by the irradiation of the laser, a groove length ($B_L$) in a width direction of the steel sheet may be 10 μm to 100 μm.

In order to form the groove length in the width direction of the steel sheet, when the laser has a spherical shape, a length of the laser in the width direction of the steel sheet, which irradiates the surface of the steel sheet, may be 90 μm or less, and when the laser has an oval shape, the length of the laser in the width direction of the steel sheet may be 150 μm or less.

When the groove is formed on the surface of the electrical steel sheet by the irradiation of the laser, a groove diameter ($B_W$) in a rolling direction may be 10 μm to 70 μm, and a groove length ($B_L$) in a width direction of the steel sheet may be 10 μm to 100 μm.

When the laser irradiates, an irradiation distance ($D_S$) in a rolling direction may be 3 mm to 30 mm.

In the groove formed on the surface of the electrical steel sheet by the irradiation of the laser, when a side surface distance (C) is defined as a distance between a boundary formed by the surface of the steel sheet and the side surface and a center of the bottom surface of the groove, the solidification portion formed on the first side surface or the second side surface may occupy 2% or more of the side surface distance.

When a groove shape factor is defined as (depth ($D_G$) of groove)/(lower full width at half maximum ($W_1$)) at the time of forming the groove, the groove shape factor may be 0.1 to 9.0. Here, the depth ($D_G$) of the groove is a distance between the surface of the steel sheet and the bottom surface, and the lower full width at half maximum ($W_1$) is half of a length of the bottom surface in a rolling direction of the steel sheet.

The laser may irradiate by being divided into three to six in a width direction of the steel sheet.

Yet another exemplary embodiment of the present invention provides an apparatus for miniaturizing a magnetic domain of an electrical steel sheet, including a laser generating unit that generates a laser which irradiates a steel sheet to melt a surface, a shaping mirror that controls a shape of an incident beam introduced to the steel sheet, a movable focal distance control unit that adjusts a focal distance of the incident beam introduced to the steel sheet while moving along with a moving speed of the steel sheet, and a melted byproduct removing unit that removes melted byproducts generated when the surface of the steel sheet is melted by the laser irradiation.

The shaping mirror may include a plurality of mirrors, and two mirrors may be interlocked to form a circular or oval beam.

The movable focal distance control unit may include a polygon scanner mirror and a focus mirror, and may be driven by adjusting a rotational speed of the polygon scanner mirror.

Advantageous Effects

According to exemplary embodiments of the present invention, it is possible to exhibit a magnetic domain miniaturizing effect by a tension effect due to a solidification structure of a melted portion before a stress relief annealing process, and to further maximize the magnetic domain miniaturizing effect by ensuring a static magnetic effect due to tension and the groove after the stress relief annealing process by allowing a continuous wave laser beam to irradiate a surface of an electrical steel sheet to form a groove and forming the melted portion on an inner wall of the groove by the laser irradiation.

MODE FOR INVENTION

Figure 1:
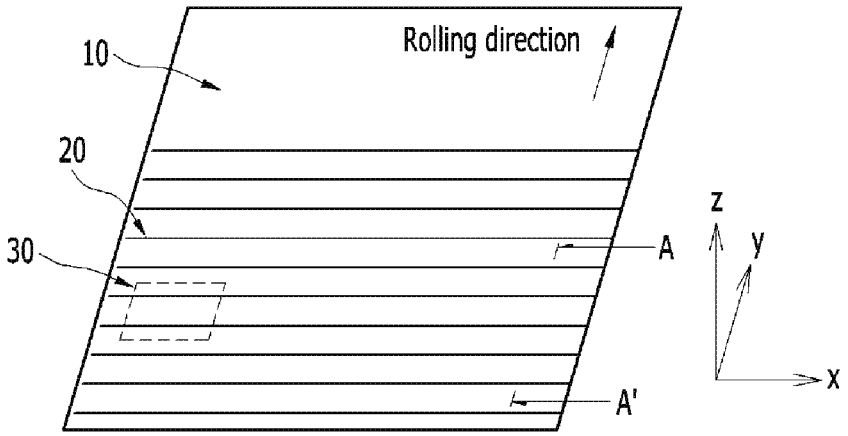
FIG. 1 is a schematic diagram illustrating a case where a laser irradiates a surface of a grain-oriented electrical steel sheet according to an exemplary embodiment of the present invention in a direction perpendicular to a rolling direction.

Merits and characteristics of the present invention, and methods for accomplishing them, will become more apparent from the following exemplary embodiments taken in conjunction with the accompanying drawings. However, the present invention is not limited to the disclosed exemplary embodiments, and may be implemented in various manners. The embodiments are provided to complete the disclosure of the present invention and to allow those having ordinary skill in the art to understand the scope of the present invention. The present invention is defined by the appended claims. Throughout the specification, the same constituent elements will be assigned the same reference numerals.

Hereinafter, an electrical steel sheet in which a groove is formed on a surface of a steel sheet in order to miniaturize a magnetic domain according to preferred exemplary embodiments of the present invention will be described.

FIG. 1 is a diagram illustrating irradiation of rays 20 of a laser that is vertically irradiated in a rolling direction of an electrical steel sheet 10 at a predetermined distance.

Figure 3:
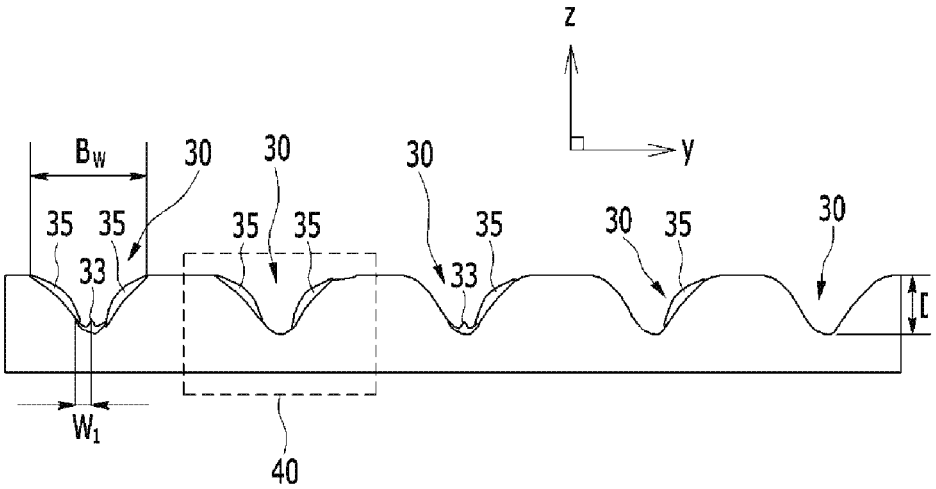
FIG. 3 is a cross-sectional view taken along A-A' of the steel sheet shown in FIG. 1.

FIG. 3 shows cross-sections of various shapes of grooves 30 formed on a surface of the steel sheet by the laser irradiation shown in FIG. 1.

Referring to FIG. 3, the electrical steel sheet according to the preferred exemplary embodiment of the present invention includes a groove 30 that has first and second side surfaces which face each other and a bottom surface on a steel sheet, and an opening that is formed by removing solidification portions formed by solidifying melted byproducts of the steel sheet to expose at least one surface of the first side surface, the second side surface, and the bottom surface in the forming of the groove 30 on the first and second side surfaces and the bottom surface.

Figure 4:
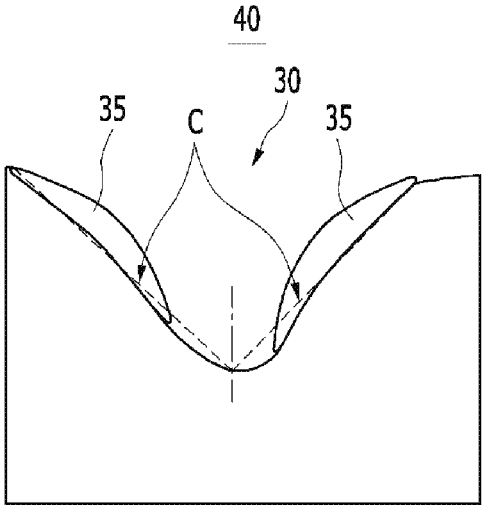
FIG. 4 is an enlarged view of a solidification formed on an inner surface of the groove shown in FIG. 3.

FIG. 4 illustrates solidification portions 35 formed by melted byproducts on the first and second side surfaces of the groove formed on the steel sheet. It is illustrated that the solidification portion is not formed on the bottom surface of the groove.

Referring to FIG. 4, the solidification portion 35 formed on the first side surface or the second side surface occupies 2% or more of a side surface distance C.

Further, referring to FIG. 3, it is characterized in that a groove shape factor ($D_G/W_I$) is 0.1 to 9.0.

In order to form the groove 30 on the surface of the electrical steel sheet, the groove 30 is formed by allowing a continuous wave laser to irradiate the surface of the steel sheet to melt the surface of the steel sheet, and the solidification portions of the melted byproducts are formed on the first and second side surfaces of the groove 30.

A grain-oriented electrical steel sheet may be used as the electrical steel sheet, and since the grain-oriented electrical steel sheet exhibits GOSS texture in which texture of the steel sheet is oriented in the rolling direction, the grain-oriented electrical steel sheet is a soft ferrite material having an excellent magnetic characteristic in one direction or in the rolling direction.

The grain-oriented electrical steel sheet exhibits the excellent magnetic characteristic in the rolling direction, and thus the grain-oriented electrical steel sheet is used as an iron core material of a transformer, an electric motor, a generator, or other electronic devices.

In general, the grain-oriented electrical steel sheet is manufactured by performing a hot rolling process, a preliminary annealing process, a cold rolling process, a decarburizing annealing process, a high-temperature annealing process, a planarization annealing and insulation coating process, and a correction and laser process on a slab manufactured through a continuous casting process.

As the grain-oriented electrical steel sheet that the laser irradiates, a steel sheet on which the high-temperature annealing process for secondary recrystallization of the steel sheet has been finished and a tension coating process has been performed, or a steel sheet on which the high-temperature annealing process has finished and the tension coating process is not performed may be used.

A method for manufacturing an electrical steel sheet according to an exemplary embodiment of the present invention includes forming a groove having first and second side surfaces and a bottom surface formed by melting a surface of a steel sheet by laser irradiation, and forming an opening by removing melted byproducts of the steel sheet formed on the first and second side surfaces and the bottom surface through air blowing or suctioning to expose at least one surface of the first side surface, the second side surface, and the bottom surface in the forming of the groove.

Figure 2:
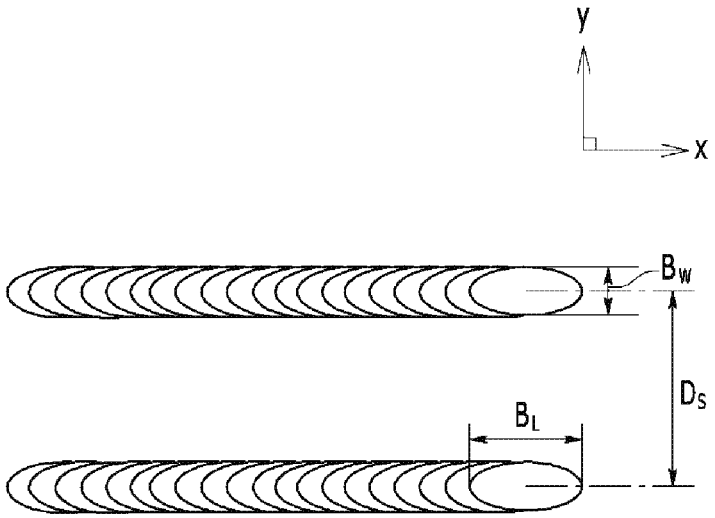
FIG. 2 is a diagram illustrating a shape of a groove in an irradiated portion on an XY plane when the laser irradiates the surface of the steel sheet.

FIG. 2 shows a portion 30 corresponding to two irradiation rays of the steel sheet shown in FIG. 1 on which the laser irradiates represented on an XY plane, and schematically illustrates a case where the groove is formed by melting the surface by the irradiation of the laser to remove the melted byproducts.

The first and second side surfaces formed on both side surfaces while the groove is formed will not be illustrated.

A groove diameter $B_W$ in the rolling direction, a groove length $B_L$ in a width direction of the steel sheet, and an irradiation distance $D_S$ of the laser beam in the rolling direction are illustrated in FIG. 2.

It is characterized in that, when the groove is formed on the surface of the steel sheet by the radiation of the laser, the groove diameter $B_W$ in the rolling direction is 10 μm to 70 μm. When a width of the laser in the rolling direction, which irradiates the surface of the electrical steel sheet, is 60 μm or less as will be described below, the groove diameter in the rolling direction is adjusted in consideration of influence of a heat affected zone (HAZ) adjacent to the melted portion in the irradiated portion.

More specifically, when the groove diameter $B_W$ in the rolling direction is less than 10 μm, an iron loss improvement effect after a stress relief annealing (SRA) process is not exhibited, and when the groove diameter in the rolling direction is more than 70 μm, since thermal influence by the continuous wave laser is increased, the iron loss improvement effect before the annealing process is not exhibited, and magnetic flux density is largely degraded.

Furthermore, in order to form the groove diameter $B_W$ in the rolling direction, the width of the laser beam in the rolling direction, which irradiates the surface of the electrical steel sheet, is adjusted to 60 μm or less.

Meanwhile, it is characterized in that, when the groove is formed on the surface of the steel sheet by the irradiation of the laser, the groove length $B_L$ in the width direction of the steel sheet is 10 μm to 150 μm.

When a spherical or oval laser having a predetermined length in the width direction of the steel sheet is irradiated, the groove length in the width direction of the steel sheet is adjusted in consideration of the influence of the heat affected zone (HAZ) adjacent to the melted portion as will be described below.

More specifically, when the groove length in the width direction of the steel sheet is less than 10 μm, the iron less improvement effect is not exhibited before the stress relief annealing (SRA) process, and when the groove length in the width direction of the steel sheet is more than 150 μm, magnetic flux density and iron loss before the stress relief annealing process are degraded.

It is characterized in that, in order to form the groove length in the width direction of the steel sheet, when the laser has the spherical shape, the length of the laser in the width direction of the steel sheet, which irradiates the surface of the steel sheet, is 90 μm or less, and when the laser has the oval shape, the length of the laser in the width direction of the steel sheet is 150 μm or less.

It is further characterized in that, when the laser irradiates, the irradiation distance $D_s$ in the rolling direction is 3 mm to 30 mm in order to minimize the influence of the heat affected zone of the continuous wave laser beam.

FIG. 3 shows a cross-section of the steel sheet shown in FIG. 1 in an A-A' direction, and illustrates the solidification portions 35 formed on the bottom surface of the groove 30 and the first and second sides surfaces of the groove 30.

A left side of FIG. 3 shows a case where the solidification portions are formed on the first and second side surfaces and the bottom surface by the laser irradiation.

A second drawing and the other drawings from the left side of FIG. 3 show cases where the groove according to the preferred exemplary embodiment of the present invention is formed. FIG. 3 shows a case where the solidification portions 35 are formed only on the first and second side surfaces of the groove without the solidification portion on the bottom surface, a case where solidification portions 33 and 35 are formed on the bottom surface and only one surface of the second side surface, a case where the solidification portion 35 is formed only on one surface of the second side surface of the groove, and a case where only the groove is formed and the solidification portion does not remain.

It is characterized in that, in the groove formed on the surface of the steel sheet by the irradiation of the laser, the solidification portion 35 formed on the first or second side surface of the groove occupies 2% or more of the first or second side surface distance.

FIG. 4 is a detailed diagram of a portion where the solidification portions are formed only on the first and second side surfaces of the groove of FIG. 3. More specifically, FIG. 4 is an enlarged cross-sectional view of a groove taken along the line A-A' in FIG. 1.

As shown in FIG. 4, the first or second side surface distance C means a straight line distance from a center of the bottom surface of the groove 30 to a boundary location where the side wall intersects the surface of the steel sheet.

When the portion that the solidification portion 35 occupies is less than 2% of the first or second side surface distance C, since the iron loss improvement effect before the annealing process is not exhibited, it is not preferred.

When the groove is formed on the surface of the steel sheet by the irradiation of the laser, if the groove shape factor is defined as (depth $D_G$ of groove)/(lower full width at half maximum $W_1$), the groove shape factor is 0.1 to 9.0.

The groove depth $D_G$ of the groove shape factor means a depth between the surface of the steel sheet and a valley of the solidification portion formed on the bottom surface of the groove.

Meanwhile, when the solidification portion is removed from the bottom surface of the groove, the groove depth means a distance between the surface of the steel sheet and the bottom surface of the groove.

As shown in FIG. 3, the lower full width at half maximum $W_1$ means half of the length of the bottom surface in the rolling direction of the steel sheet. The length of the bottom surface in the rolling direction of the steel sheet may be a straight distance between boundary points formed by the bottom surface and the first and second side surfaces.

It is characterized in that the laser irradiates an electrical steel sheet of which the high-temperature annealing process for secondary recrystallization of the steel sheet and the tension coating process have been performed or an electrical steel sheet of which the high-temperature annealing process for secondary recrystallization of the steel sheet has been performed and the tension coating process is not performed.

It is characterized in that the melted byproducts formed on the surface by allowing the laser irradiation to irradiate the electrical steel sheet are removed through air blowing or suctioning.

The solidification portions formed within the groove through the air blowing or suctioning are simultaneously or separately formed on the first and second side surfaces and the bottom surface of the groove. In order to form solidification structures of the melted byproducts only on the first and second side surfaces of the groove, molten metal formed on the groove by the laser irradiation is scattered to the outside by injecting air or is moved to the first and second side surfaces of the groove through blowing.

The solidification portions may not be formed on the bottom surface of the groove by removing the melted byproducts formed on the bottom surface of the groove by using a suction device.

Figure 5:
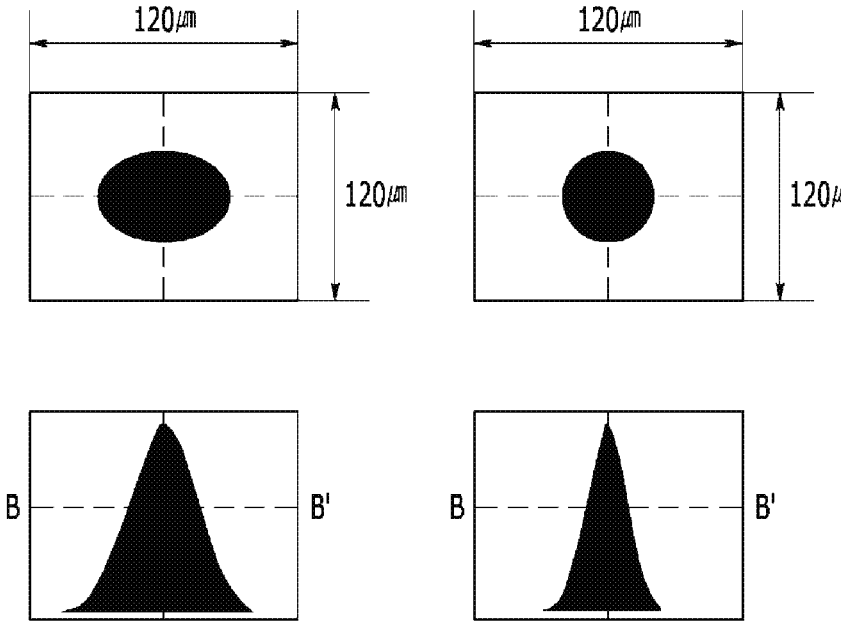
FIG. 5 shows a shape and a mode of a laser beam that irradiates a surface of a steel sheet when a magnetic domain of the grain-oriented electrical steel sheet according to the present invention is miniaturized.

FIG. 5 illustrates shapes of continuous wave lasers that irradiate the surface to form the groove on the surface of the electrical steel sheet in the present invention, and illustrates a case where the laser has the spherical shape or the oval shape.

A shape of a laser beam formed by the continuous wave laser is a single mode shape of the spherical shape or the oval shape as shown in FIG. 5. FIG. 5 shows the shapes of the spherical and oval laser and Gaussian modes of the lasers, and it can be seen from FIG. 5 that all of the shapes are single modes.

Figure 6:
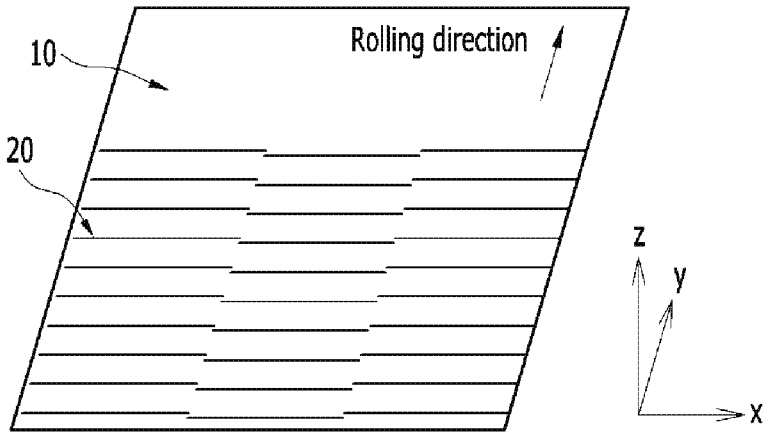
FIG. 6 is a diagram illustrating a case where the laser irradiates the surface of the grain-oriented electrical steel sheet according to the present invention in a width direction of the steel sheet by being divided into three.

FIG. 6 shows a case where laser irradiation ray 20 which irradiates the surface of the steel sheet is divided (separated) into three, and the laser irradiates by being divided into three or six in the width direction of the steel sheet.

Figure 7:
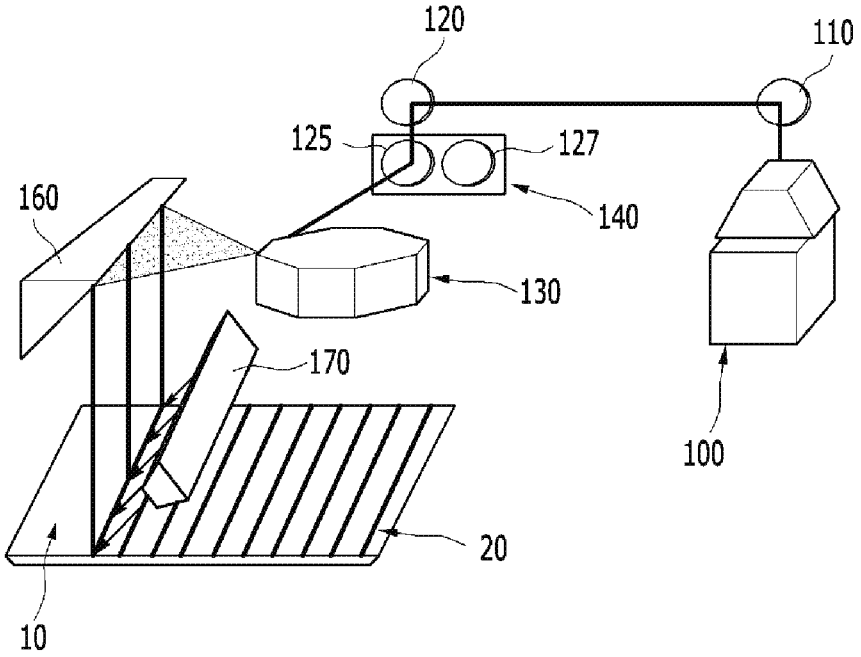
FIG. 7 is a schematic diagram of a configuration of an apparatus for miniaturizing a magnetic domain that allows a laser to irradiate the surface of the electrical steel sheet according to the present invention.

In order to intermittently form a plurality of grooves in the width direction of the steel sheet shown in FIG. 6, an apparatus for miniaturizing a magnetic domain shown in FIG. 7 is provided in a plural number to allow the laser to irradiate the surface of the steel sheet.

Hereinafter, a method for miniaturizing a magnetic domain of a grain-oriented electrical steel sheet according to the present invention will be described in detail in connection with exemplary embodiments. However, the following exemplary embodiments are merely presented as examples of the present invention, and the present invention is not limited to the following exemplary embodiments.

<Exemplary Embodiment: Miniaturizing of Magnetic Domain of Electrical Steel Sheet by Continuous Wave Laser Irradiation>

FIG. 7 shows a magnetic domain miniaturizing apparatus for miniaturizing a magnetic domain of an electrical steel sheet by allowing a continuous wave laser beam to irradiate the electrical steel sheet of the present invention.

Referring to FIG. 7, it is characterized in that the apparatus for miniaturizing a magnetic domain of a grain-oriented electrical steel sheet according to the present invention includes a laser generating unit 100 that generates a laser which irradiates the steel sheet to melt the surface thereof, shaping mirrors 120, 125 and 127 that control a shape of an incident beam introduced to the steel sheet, a movable focal distance control unit that adjusts a focal distance of the incident beam introduced to the steel sheet while moving along with a moving speed of the steel sheet, and a melted byproduct removing unit 170 that removes melted byproducts generated when the surface of the steel sheet is melted by the laser irradiation.

It is characterized in that the shaping mirrors 120, 125 and 127 are a plurality of mirrors, and two mirrors are interlocked to form a circular or oval beam.

It is characterized in that the movable focal distance control unit includes a polygon scanner mirror 130 and a focus mirror 160, and is driven by adjusting a rotational speed of the polygon scanner mirror 130.

The laser generating unit 100 generates a continuous wave laser. The generated laser passes through a total reflection mirror 110, and is converted by the plurality of shaping mirrors 120, 125, and 127 of which two mirrors are interlocked to convert the laser into the circular or oval laser. Thereafter, the laser is introduced to the steel sheet by the movable focal distance control unit that adjusts the focal distance of the incident beam of the laser introduced from the shaping mirrors 120, 125, and 127 to the steel sheet while moving at a predetermined rotational speed.

The movable focal distance control unit includes the polygon scanner mirror 130 and the focus mirror 160.

When the laser is introduced to the steel sheet to melt the surface of the steel sheet, the grooves are formed on the surface of the steel sheet by removing the melted byproducts by an air blower or a suction device.

The melted byproducts may be removed by scattering the melted byproducts by the air blower.

When the laser beams irradiate in parallel to each other in a rolling width direction of the steel sheet by using the laser irradiation device shown in FIG. 7, the groove formed by the continuous wave laser has the solidification portions 33 and 35 formed by solidifying the melted byproducts on the bottom surface and the first and second side surfaces as shown in FIGS. 3 and 4, and the irradiation distance $D_S$ of the groove is adjusted by adjusting the rotational speed of the polygon scanner mirror 130 in a laser optical system.

Referring to FIG. 7, after the continuous laser beam generated from the laser generating unit 100 passes through the total reflection mirror 110, the shape of the beam which irradiates the steel sheet is change to the spherical or oval shape through the plurality of shaping mirrors 120, 125 and 127. The spherical or oval beam is formed by selectively using the shaping mirrors 125 and 127 through a cylinder 140.

That is, in order to implement the shape of the laser, the laser may be formed in the circular shape by interlocking two shaping mirrors 120 and 125, and the laser may be formed in the oval shape by interlocking the two shaping mirrors 120 and 127.

That is, by selectively moving the two shaping mirrors 125 and 127 by the cylinder 140, the circular or oval beam may be formed by a combination with the shaping mirror 120 at a front stage. The shaping mirrors 120, 125, and 127 are formed so as to have different curvatures from each other.

After the laser converted so as to have a predetermined shape by the shaping mirrors 125 and 127 passes through the polygon scanner mirror 130, the continuous wave laser irradiates the steel sheet in the focus mirror 160. The laser irradiation rays 20 that irradiate the steel sheet 10 can be adjusted from 3 to 30 mm by adjusting the rotational speed of the polygon scanner mirror 130.

The polygon scanner mirror 130 is configured such that several plane mirrors are attached to a surface of a circular rotating body, each mirror is rotated to allow the laser beam to irradiate the surface of the steel sheet for a short time, and the adjacent mirror receives the laser beam to continuously irradiate.

Meanwhile, the groove from which the melted byproducts are removed may be formed by scattering the melted byproducts formed on the surface of the steel sheet, or the solidification portions formed by solidifying the melted byproducts may be formed on the first and second side surfaces of the groove. In order to scatter the melted byproducts, a melted byproduct removing means for introducing air may be used. Moreover, a suction means for removing the melted byproducts may be used.

Table

Table 1 represents a change of an iron loss improvement rate of a grain-oriented electrical steel sheet by solidification structures of melted byproducts and grooves formed on a surface of a steel sheet having a thickness of 0.27 mm by the continuous wave laser irradiation of the present invention.

TABLE 1

| Category | $B_W$ | $B_L$ μm | $D_G$ | $D_G/W_1$ dimensionless | $D_S$ mm | Before laser irradiation | After laser irradiation W17/50 | After SRA | Iron loss improvement rate After irradiation | Iron loss improvement rate After SRA |
|---|---|---|---|---|---|---|---|---|---|---|
| Invention Example 1 (continuous wave laser/oval shape) | 40 | 55 | 15 | 2.3 | 4.5 | 0.95<br>0.93<br>0.96 | 0.86<br>0.84<br>0.85 | 0.84<br>0.81<br>0.83 | 9.5<br>9.7<br>11.5 | 11.6<br>12.9<br>13.5 |
| Invention Example 2 (continuous wave laser/ circular shape) | 40 | 45 | 15 | 2.3 | 4 | 0.95<br>0.93<br>0.94 | 0.87<br>0.85<br>0.86 | 0.84<br>0.82<br>0.83 | 8.4<br>8.6<br>8.5 | 11.6<br>11.8<br>11.7 |
| Comparative Example (pulse laser/ discontinuous groove) | 50 | 90 | 15 | 2.3 | 6 | 0.95<br>0.94 | 0.96<br>0.97 | 0.89<br>0.88 | −1.1<br>−3.2 | 6.3<br>6.4 |

As represented in Table 1, the laser beam irradiates at an angle of 85 to 95° in a progressing direction of the steel sheet to form a groove having a lower width $W_1$ of 10 μm or less and a depth of 3 to 30 μm on the surface of the steel sheet, so that it is possible to improve the iron loss improvement rate before the annealing process by up to 7% or more and the iron loss improvement rate after the annealing process by up to 10% or more.

The exemplary embodiments of the present invention have been described with reference to the accompanying drawings. However, it should be understood by those skilled in the art that the present invention can be implemented as other concrete embodiments without changing the technical spirit or essential features of the present invention.

Therefore, it should be understood that the exemplary embodiments described above are merely examples in all aspects, and are not intended to limit the present invention. The scope of the present invention is defined by the appended claims other than the detailed description, and all changes or modifications derived from the meaning and scope of the appended claims and their equivalents should be interpreted as falling within the scope of the present invention.

What is claimed is:

1. An electrical steel sheet comprising:

a groove formed in a surface of a steel sheet, wherein the groove includes a bottom surface, a first side surface extending from the bottom surface, and a second side surface in opposite to the first side surface and extending from the bottom surface, wherein the groove has a depth ($D_G$) from the bottom surface, a width ($B_W$) in a rolling direction of the steel sheet, and a length ($B_L$) in a width direction of the steel sheet, and wherein the groove is formed through laser-irradiation and removal of melt produced by the laser-irradiation;

an opening defined by the bottom surface, the first side surface and the second side surface; and a first solidification portion formed on the first side surface of the groove, wherein the first solidification portion is formed of a solidified part of the melt produced from the laser-irradiation, wherein the first solidification portion has a thickness gradually decreasing toward the bottom surface and gradually decreasing toward the surface of the steel sheet.

2. The electrical steel sheet of claim 1, wherein the groove has a first side surface distance (C) defined by a straight line distance from a center of the bottom surface to a boundary location where the first side surface intersects the surface of the steel sheet, and the first solidification portion occupies 2% or more of the first side surface distance.

3. The electrical steel sheet of claim 1, wherein the groove has a groove shape factor defined by (the depth ($D_G$))/(a lower full width at half maximum ($W_1$)), wherein the groove shape factor is 0.1 to 9.0, and wherein the depth ($D_G$) is a vertical distance between the surface of the steel sheet and the bottom surface, and the lower full width at half maximum ($W_1$) is half of a length of the bottom surface in the rolling direction of the steel sheet.

4. The electrical steel sheet of claim 1, wherein the width ($B_W$) is in a range of 10 μm to 70 μm.

5. The electrical steel sheet of claim 1, wherein the depth ($D_G$) is in a range of 3 μm to 30 μm.

6. The electrical steel sheet of claim 1, wherein the solidification portion has a thickness in a range of 0.05 $W_1$ to 5 $W_1$, where the $W_1$ means a lower full width at half maximum, and the lower full width at half maximum ($W_1$) is half of a length of the bottom surface in the rolling direction of the steel sheet.

7. The electrical steel sheet of claim 1, further comprising: a second solidification portion formed on the second side surface of the groove.

8. The electrical steel sheet of claim 1, further comprising: a bottom solidification portion formed on the bottom surface of the groove.

* * * * *